US006860723B2

(12) United States Patent
Chen et al.

(10) Patent No.: US 6,860,723 B2
(45) Date of Patent: Mar. 1, 2005

(54) SLURRY FLOW CONTROL AND MONITOR SYSTEM FOR CHEMICAL MECHANICAL POLISHER

(75) Inventors: Ben-Shu Chen, Taichung (TW); Chao-Jung Chang, Yunghe (TW); Jui-Cheng Lo, Hsinchu (TW); Chin-Hsin Peng, Hsinchu (TW); Chien-Kuo Lu, Hsichu (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 0 days.

(21) Appl. No.: 10/264,404

(22) Filed: Oct. 9, 2002

(65) Prior Publication Data

US 2004/0071555 A1 Apr. 15, 2004

(51) Int. Cl.[7] ..... F04B 49/00
(52) U.S. Cl. ..... 417/43; 417/313
(58) Field of Search ..... 417/43, 38, 40, 417/53, 63; 415/5, 60; 137/197, 199, 202, 42, 11, 111, 113; 412/313; 451/5, 60; 134/42, 11, 111, 113, 184, 57 R, 58 R

(56) References Cited

U.S. PATENT DOCUMENTS 3,816,102 A * 6/1974 Celada et al. ..... 75/387
4,060,485 A * 11/1977 Eaton ..... 210/87
4,348,280 A * 9/1982 George et al. ..... 210/101
5,562,834 A * 10/1996 Bremer et al. ..... 210/750
5,647,386 A * 7/1997 Kaiser ..... 134/113
5,672,374 A * 9/1997 McCabe ..... 426/635
5,885,134 A * 3/1999 Shibata et al. ..... 451/41
6,395,228 B1 * 5/2002 Maggard et al. ..... 422/82.05
6,439,804 B1 * 8/2002 Crupi ..... 404/75
6,505,134 B2 * 1/2003 Poleshuk et al. ..... 702/100

FOREIGN PATENT DOCUMENTS

JP 2000-317811 A * 11/2000 ..... B24B/37/00

* cited by examiner

*Primary Examiner*—Michael Koczo
(74) *Attorney, Agent, or Firm*—Tung & Associates

(57) ABSTRACT

A system for controlling and monitoring a rate of flow of a fluid, such as a CMP slurry, comprising a pump for pumping the slurry; a flow meter for monitoring the rate of flow of the slurry; and a controller operably connected to the flow meter and the pump. The controller receives signals from the flow meter indicating the rate of flow of the slurry and controls the operational speed of the pump responsive to the flow meter signals. A degasser equipped with a level sensor may be further provided in the system for removing gas bubbles from the slurry.

10 Claims, 3 Drawing Sheets

SLURRY FLOW CONTROL AND MONITOR SYSTEM FOR CHEMICAL MECHANICAL POLISHER

FIELD OF THE INVENTION

The present invention relates to chemical mechanical polishers used for polishing semiconductor wafers in the semiconductor fabrication industry. More particularly, the present invention relates to a new and improved slurry flow control and monitor system for monitoring and controlling flow of slurry to a chemical mechanical polisher for the polishing of semiconductor wafers.

BACKGROUND OF THE INVENTION

Apparatus for polishing thin, flat semiconductor wafers are well-known in the art. Such apparatus normally includes a polishing head which carries a membrane for engaging and forcing a semiconductor wafer against a wetted polishing surface, such as a polishing pad. Either the pad or the polishing head is rotated and oscillates the wafer over the polishing surface. The polishing head is forced downwardly onto the polishing surface by a pressurized air system or similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head, a wafer unload station, or a wafer load station.

More recently, chemical-mechanical polishing (CMP) apparatus has been employed in combination with a pneumatically-actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in deionized water.

CMP polishing results from a combination of chemical and mechanical effects. A possible mechanism for the CMP process involves the formation of a chemically altered layer at the surface of the material being polished. The layer is mechanically removed from the underlying bulk material. An altered layer is then regrown on the surface while the process is repeated again. For instance, in metal polishing, a metal oxide may be formed and removed separately. The chemical mechanical polishing method can be used to provide a planar surface on dielectric layers, on deep and shallow trenches that are filled with polysilicon or oxide, and on various metal films.

Referring initially to FIG. 1, a conventional CMP apparatus 50 includes a conditioning head 52, a polishing pad 56, and a slurry delivery arm 54 positioned over the polishing pad 56. The conditioning head 52 is mounted on a conditioning arm 58 which is extended over the top of the polishing pad 56 for making a sweeping motion across the entire surface of the polishing pad 56. The slurry delivery arm 54 is equipped with slurry dispensing nozzles 62 which are used for dispensing a slurry solution on the top surface 60 of the polishing pad 56. Surface grooves 64 are further provided in the top surface 60 to facilitate even distribution of the slurry solution and to help entrapping undesirable particles that are generated by coagulated slurry solution or any other foreign particles which have fallen on top of the polishing pad 56 during a polishing process. The surface grooves 64, while serving an important function of distributing the slurry, also presents a processing problem when the pad surface 60 gradually wears out after prolonged use.

The slurry solution is typically distributed to the slurry dispensing nozzles 62 through tubing (not illustrated), by operation of a pump (not illustrated). Currently, no system exists for accurate in-situ monitoring of the flow rate and precise control of the flow rate of the slurry solution from the pump to the CMP apparatus. Excessively high flow rates of the slurry to the CMP apparatus tend to waste the slurry, whereas excessively low flow rates of the slurry to the CMP apparatus causes inadequate supply of the slurry to the wafer, and thus, hinders optimum polishing. Additionally, slurry flow rates which are characteristic of conventional systems are frequently variable and unstable. Moreover, conventional slurry delivery systems are typically incapable of controlling the mixing ratio of the slurry components. Accordingly, a system is needed for accurately monitoring the flow rate of slurry from a slurry pump to a CMP apparatus and precisely controlling the flow rate of the slurry to the apparatus for economical and optimum chemical mechanical polishing.

An object of the present invention is to provide a system for monitoring the rate of delivery of a fluid to a destination.

Another object of the present invention is to provide a system for controlling the rate of delivery of a fluid to a destination.

Still another object of the present invention is to provide a system for both accurately monitoring and precisely controlling the rate of delivery of a fluid to a destination.

Another object of the present invention is to provide a system which facilitates control in mixing slurry components.

Yet another object of the present invention is to provide a system for delivering a fluid to a destination in a substantially bubble-free condition.

A still further object of the present invention is to provide a system for removing gas bubbles from a liquid and monitoring and controlling the rate of delivery of the liquid to a destination.

Still another object of the present invention is to provide a closed-loop system for in-situ monitoring and controlling of the rate of delivery of a polishing slurry to a chemical mechanical polisher.

Another object of the present invention is to provide a system for improving the dishing range for chemical mechanical polishers.

Yet another object of the present invention is to provide a system which is capable of reducing the rate of flow of polishing slurry to a chemical mechanical polisher to avoid or reduce wasting of the slurry.

A further object of the present invention is to provide a novel degasser for removing gas bubbles from a polishing slurry or other liquid.

SUMMARY OF THE INVENTION

In accordance with these and other objects and advantages, the present invention is generally directed to a new and improved slurry flow control and monitor system which is suitable for monitoring and controlling delivery of a liquid polishing slurry to a CMP (chemical mechanical polishing) apparatus for the polishing of semiconductor wafers. In a typical embodiment, the invention may include a slurry pump, a degasser provided in fluid communication with the slurry pump, and a flow meter provided in fluid communication with the degasser, which degasser and flow meter may be operably connected to a central controller. The CMP apparatus is provided in fluid communication with the flow meter. The central controller is operably connected to the slurry pump and to a pressure relief valve in the degasser for automatically controlling those elements of the system responsive to slurry flow rate input from the flow meter and degasser and gas pressure input from the degasser.

In operation, the slurry pump pumps a supply of liquid slurry first through the degasser, which removes gas bubbles from the slurry. The degassed slurry then flows through the flow meter, and finally, to the CMP apparatus. Signals which correspond to the flow rate of the slurry are transmitted from the degasser and the flow meter, respectively, to the central controller. Signals which correspond to gas pressure in the degasser may further be transmitted from the degasser to the central controller. The central controller, in turn, controls the operational speed of the slurry pump, as well as venting of gas pressure from the degasser.

The degasser typically includes a tank that is fitted with an intake arm for receiving the slurry from the slurry pump and an outlet arm through which the slurry flows to the flow meter. A vent pipe fitted with a pressure relief valve may extend from the tank for releasing buildup of gas pressure from the tank as a result of the bursting of gas bubbles from the slurry in the tank. The central controller may be operably connected to the pressure relief valve for automatically controlling release of the pressure from the tank.

BRIEF DESCRIPTION OF THE DRAWINGS

The invention will now be described, by way of example, with reference to the accompanying drawings, in which.

DESCRIPTION OF THE PREFERRED EMBODIMENTS

The present invention has particularly beneficial utility in monitoring and controlling the rate of delivery of polishing slurry to a CMP (chemical mechanical polishing) apparatus in the polishing of semiconductor wafer substrates. However, the invention is not so limited in application, and while references may be made to such polishing slurry and CMP apparatus, the invention is more generally applicable to monitoring and controlling delivery of a fluid to a destination in a variety of industrial and mechanical applications.

Figure 1:
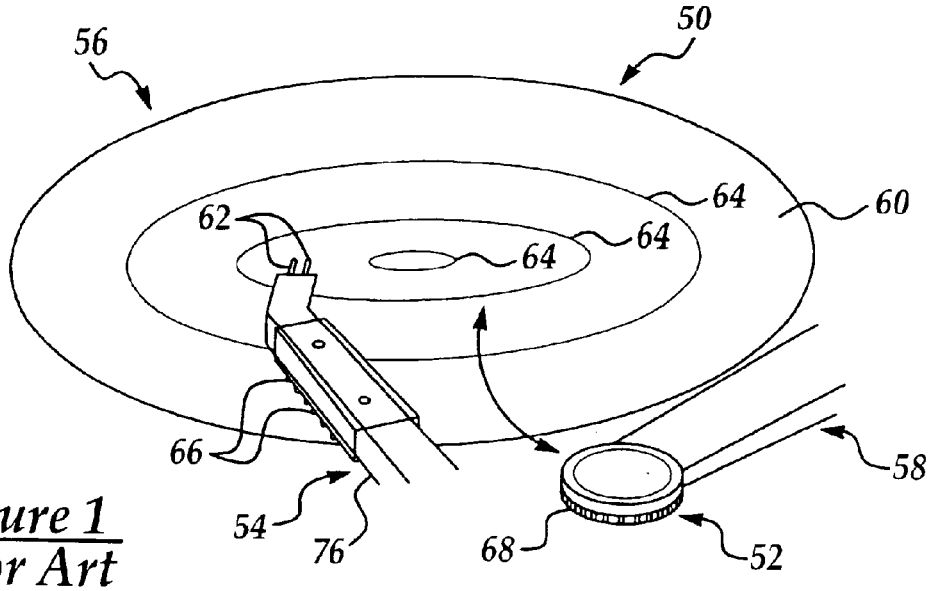
Figure 1 Prior Art
FIG. 1 is a perspective view of a conventional CMP apparatus.
Figure 2:
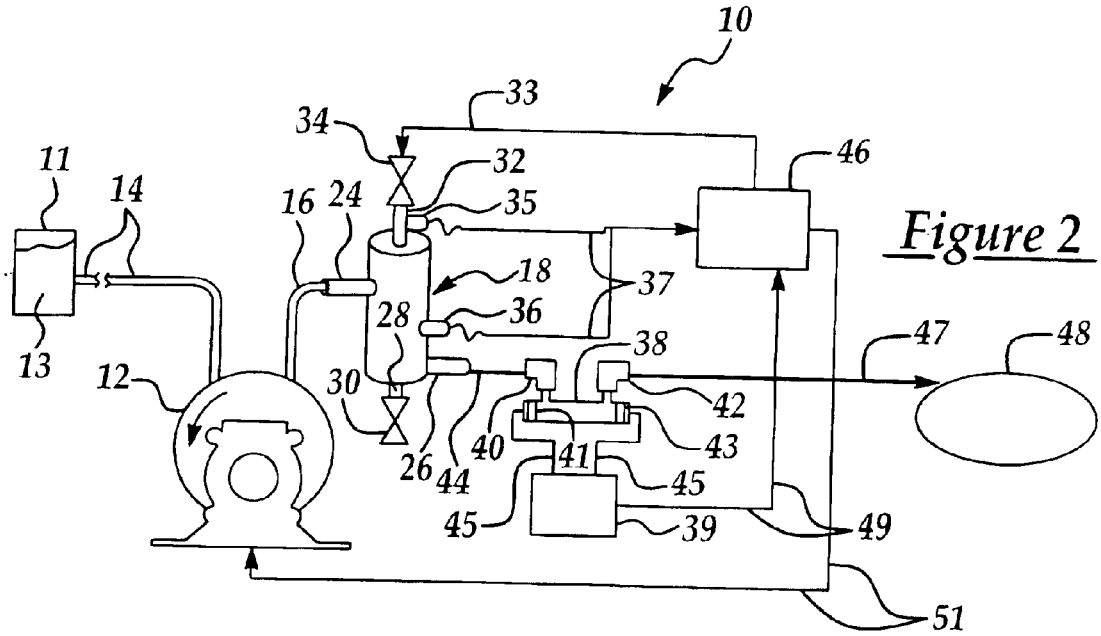
FIG. 2 is a schematic view of a slurry flow control and monitor system of the present invention.
Figure 3:
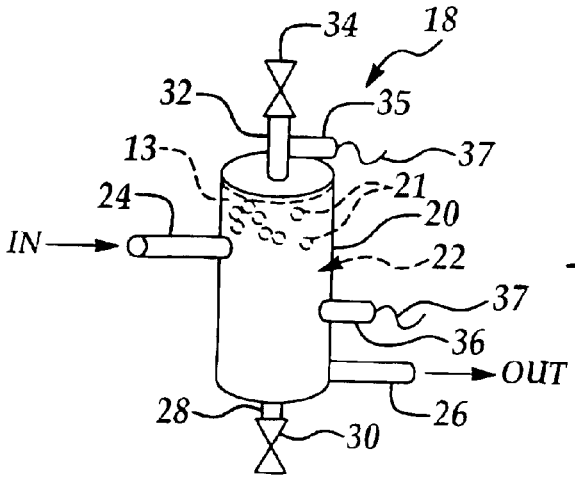
FIG. 3 is a perspective view of an illustrative degasser component of the slurry flow control and monitor system of the present invention.

Referring initially to FIGS. 2 and 3, the slurry flow control and monitor system of the present invention is generally indicated by reference numeral 10. The system 10 includes a slurry pump 12, the inlet of which is confluently connected, through a pump intake conduit 14, to a slurry tank 11 containing a supply of liquid polishing slurry 13. A pump outlet conduit 16 confluently connects the outlet of the slurry pump 12 to a tank intake arm 24 of a degasser 18.

As shown in FIG. 3, the degasser 18 may include a degasser tank 20 having a tank interior 22. A tank intake arm 24 extends from the degasser tank 20, in fluid communication with the tank interior 22, and a tank outlet arm 26 extends from the degasser tank 20 in fluid communication with the tank interior 22. The tank intake arm 24 extends from the degasser tank 20 at a higher level than does the tank outlet arm 26. A vent pipe 32, which may be fitted with a pressure relief valve 34, extends vertically from the degasser tank 20, and a pressure sensor 35, which may be conventional, may be provided in the vent pipe 32 for monitoring the pressure of gas building up inside the vent pipe 32 and/or degasser tank 20 as a result of the bursting of gas bubbles 21 in the polishing slurry 13 inside the tank interior 22, as hereinafter further described. A level sensor 36, which may be conventional, is typically provided in the degasser tank 20 for monitoring the level of the polishing slurry 13 in the degasser tank 20. As shown in FIG. 2, the pressure sensor 35 and the level sensor 36 are operably connected to a central controller 46 through suitable sensor wiring 37. The central controller 46 is typically further connected to the pressure relief valve 34, which may be an electric solenoid valve, for example, through relief valve wiring 33. A drain conduit 28, typically fitted with a drain valve 30, may be provided in the bottom of the degasser tank 20 for draining slurry from the degasser tank 20, as deemed necessary. It is understood that the degasser 18 may have any alternative design suitable for the purpose of removing gas bubbles from the polishing slurry, other than the novel design heretofore described.

As further shown in FIG. 2, the tank outlet arm 26 of the degasser 18 is typically connected, through a flow meter intake conduit 44, to a flow meter intake port 40 of a flow meter 38, which may be a conventional ultrasonic flow meter, for example. A flow meter outlet port 42 of the flow meter 38 is typically connected, through a CMP intake conduit 47, to the CMP apparatus 48, which may be conventional. An intake sensor 41, provided in the flow meter 38 adjacent to the flow meter intake port 40, is operably connected to a flow meter controller 39 through suitable flow meter wiring 45. In like manner, an outlet sensor 43, provided in the flow meter 38 adjacent to the flow meter outlet port 42, is connected to the flow meter controller 39 through flow meter wiring 45. The flow meter controller 39 is operably connected to the central controller 46 through controller wiring 49, and the central controller 46 is operably connected to the slurry pump 12 through pump wiring 51.

Referring again to FIGS. 2 and 3, in typical operation of the system 10, the slurry pump 12 is operated to pump polishing slurry 13 from the slurry tank 11, through the pump intake conduit 14, slurry pump 12 and pump outlet conduit 16, respectively, and into the degasser 18 through the tank intake arm 24. As shown in FIG. 3, in the tank interior 22 of the degasser tank 20, gas bubbles 21 in the polishing slurry 13 rise to the upper portion of the tank interior 22, and the gas bubbles 21 burst at the surface of the polishing slurry 13. Simultaneously, the polishing slurry 13, substantially devoid of, the gas bubbles 21, continually travels downwardly in the tank interior 22 along a decreasing pressure gradient between the tank intake arm 24 and the tank outlet arm 26, under influence of gravity and the pumping action of the slurry pump 12. The polishing slurry 13 exits the tank interior 22 through the tank outlet arm 26, and is distributed, through the flow meter intake conduit 44 and flow meter intake port 40, respectively, into the flow meter 38. The polishing slurry 13 then flows through the flow meter 38 and exits the flow meter 38 through the flow meter outlet port 42, and is distributed to the CMP apparatus 48 through the CMP intake conduit 47.

As the polishing slurry 13 flows through the tank interior 22 of the degasser 18, the level sensor 36 continually detects the level of the polishing slurry 13 in the degasser tank 20 and transmits a signal corresponding to the polishing slurry level through the sensor wiring 37 to the central controller 46, which continually monitors the level of the polishing slurry 13 in the degasser tank 20. Simultaneously, as the degassed polishing slurry 13 flows through the flow meter 38, the intake sensor 41 and outlet sensor 43 of the flow meter 38 transmit signals indicating the rate of flow of the polishing slurry 13 through the flow meter 38, to the flow meter controller 39 via the flow meter wiring 45. The flow meter controller 39, in turn, transmits signals corresponding to the rate of flow of the polishing slurry 13 through the flow meter 38, to the central controller 46. Accordingly, responsive to the input signals from the level sensor 36 in the degasser 18 and the flow meter controller 39, the central controller 46 continually monitors the rate of flow or delivery of the polishing slurry 13 to the CMP apparatus 48. In the event that the flow rate of the polishing slurry 13 drops to a rate below a predetermined value, such as any selected value within the range of about 120–180 cubic centimeters/min., for example, as indicated by the signals transmitted to the central controller 46 from the level sensor 36 and the flow meter controller 39, the central controller 46 increases the operational speed of the slurry pump 12 to correspondingly increase flow rate of the polishing slurry 13 to the CMP apparatus 48. Conversely, in the event that the flow rate of the polishing slurry 13 rises above the predetermined value, as indicated by the signals transmitted to the central controller 46 from the level sensor 36 and the flow meter controller 39, the central controller 46 decreases the operational speed of the slurry pump 12 to correspondingly decrease the flow rate of the polishing slurry 13 to the CMP apparatus 48. In the foregoing manner, the central controller 46 provides a substantially uniform and stable rate of flow or delivery of the polishing slurry 13 from the slurry tank 11 to the CMP apparatus 48. Furthermore, as gas pressure builds up in the tank interior 22 due to the bursting gas bubbles 21 from the polishing slurry 13, the pressure sensor 35 continually transmits signals corresponding to the magnitude of the pressure in the tank interior 22, through the sensor wiring 37 and to the central controller 46. When the magnitude of the pressure in the tank interior 22 exceeds a predetermined pressure value, such as any pressure value in the range of from about 20 psi to about 80 psi, the central controller 46 opens the pressure relief valve 34 typically by transmitting an electrical impulse through the relief valve wiring 33.

Figure 4:
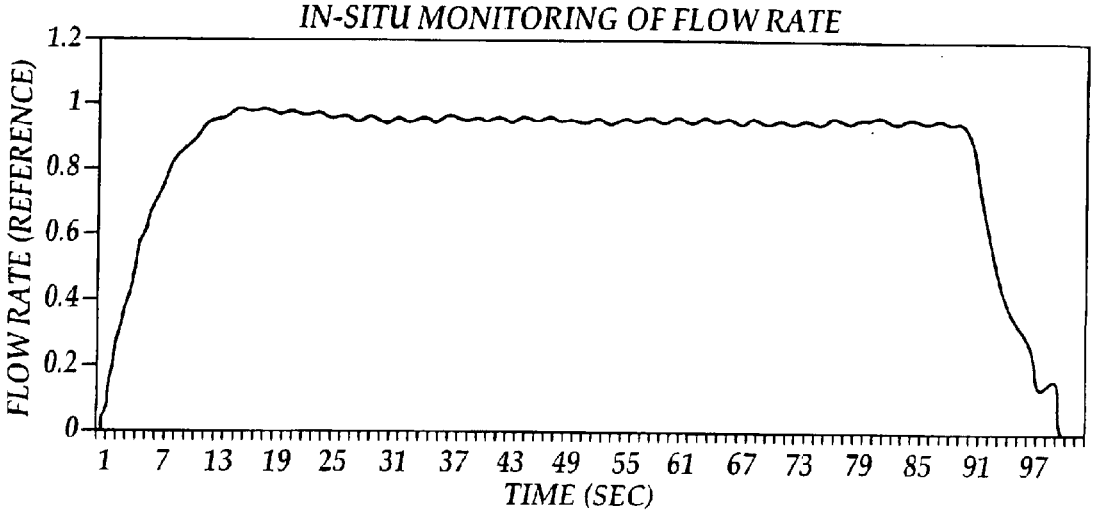
FIG. 4 is a graph which illustrates relative slurry flow rate (along the Y-axis) plotted as a function of time (along the X-axis) in seconds, in use of the present invention.
Figure 5:
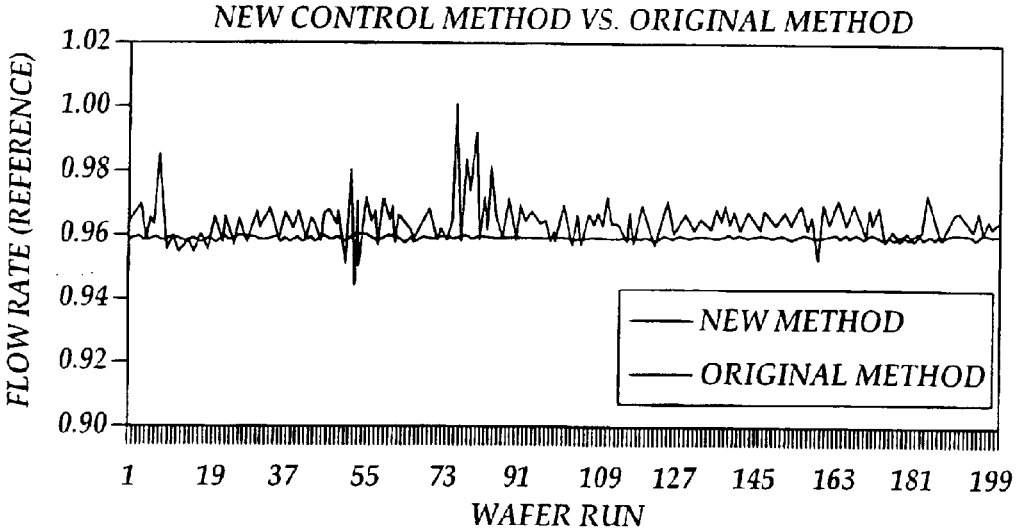
FIG. 5 is a graph which contrasts the flow rate uniformity in implementation of the present invention with the flow rate uniformity in implementation of a conventional slurry delivery system.
Figure 6:
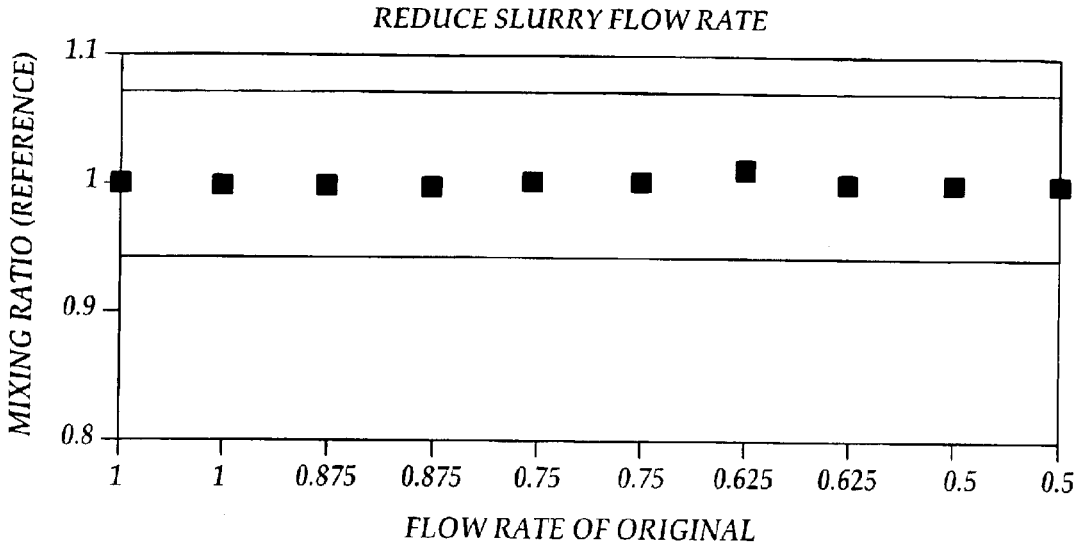
FIG. 6 is a graph which contrasts the slurry flow rate in implementation of the present invention with the slurry flow rate in implementation of a conventional slurry delivery system.
Figure 7:
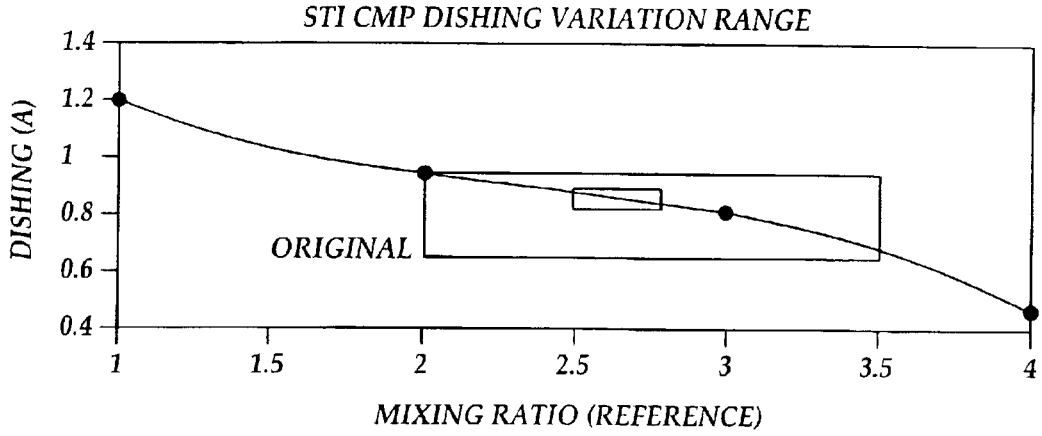
FIG. 7 is a graph which illustrates the dishing variation range between dishing achieved in implementation of the present invention and dishing achieved in implementation of a conventional slurry delivery system.

Referring next to the graphs of FIGS. 4–7, the slurry flow control and monitor system of the present invention provides several advantages over conventional systems and methods for delivering polishing slurry to a CMP apparatus. As shown in FIG. 4, the present invention is capable of providing a substantially uniform and smooth flow of polishing slurry to a CMP apparatus throughout the entire CMP process. In the graph of FIG. 5, for each of multiple CMP cycles, the relative flow rate of the polishing slurry achieved using the system of the present invention is compared to the relative flow rate of the polishing slurry achieved using a conventional slurry delivery system. The flow rate profile for the conventional slurry delivery system is represented by the multi-spiked line, whereas the flow rate profile for the system of the present invention is represented by the substantially smooth, horizontal line. Accordingly, it can be seen from the graph that the flow rate of the polishing slurry as achieved using the system of the present invention is much more uniform and stable than that achieved using the conventional system. As shown in FIG. 6, the system of the present invention is capable of reducing the total volume of slurry flowing to the CMP apparatus to 60% of the volume of slurry delivered using in the conventional system, resulting in a 40% saving by volume of the slurry. Finally, the system of the present invention is capable of reducing the dishing variation range of the slurry by as much as 50%, as shown in FIG. 7.

While the preferred embodiments of the invention have been described above, it will be recognized and understood that various modifications can be made in the invention and the appended claims are intended to cover all such modifications which may fall within the spirit and scope of the invention.

What is claimed is:

1. A system for controlling and monitoring a rate of flow of a fluid, comprising:

a conduit for receiving the fluid;

a pump provided in said conduit for pumping the fluid through said conduit;

a flow meter provided in said conduit for monitoring the rate of flow of the fluid;

a degasser provided in said conduit for removing gas bubbles from the fluid, said degasser comprises a degasser tank provided in fluid communication with said conduit for receiving the fluid from said conduit and a level sensor provided in said degasser tank and operably connected to said controller for transmitting signals indicating a level of the fluid in said degasser tank to said controller; and a controller operably connected to said flow meter for receiving signals from said flow meter indicating the rate of flow of the fluid through the conduit and operably connected to said pump for controlling an operational speed of said pump.

2. The system of claim 1 wherein said flow meter is ultrasonic.

3. The system of claim 1 further comprising a pressure sensor provided in said degasser tank and operably connected to said controller for transmitting signals indicating a gas pressure in said degasser tank to said controller and a pressure relief valve provided in said degasser tank and operably connected to said controller for releasing the gas pressure from said degasser tank responsive to operation of said controller.

4. The system of claim 3 wherein said flow meter is ultrasonic.

5. The system of claim 1 further comprising a drain conduit provided in fluid communication with said degasser tank and a drain valve provided in said drain conduit.

6. The system of claim 5 wherein said flow meter is ultrasonic.

7. The system of claim 3 further comprising a drain conduit provided in fluid communication with said degasser tank and a drain valve provided in said drain conduit.

8. The system of claim 7 wherein said flow meter is ultrasonic.

9. A system for controlling and monitoring a rate of flow of a fluid, comprising:

a conduit for receiving the fluid;

a pump provided in said conduit for pumping the fluid through said conduit;

a flow meter provided in said conduit for monitoring the rate of flow of the fluid, said flow meter is ultrasonic;

a controller operably connected to said flow meter for receiving signals from said flow meter indicating the rate of flow of the fluid through the conduit and operably connected to said pump for controlling an operational speed of said pump; and a degasser provided in said conduit for removing gas bubbles from the fluid, said degasser having a pressure sensor operably connected to said controller for transmitting signals indicating a gas pressure in said degasser to said controller and a pressure relief valve operably connected to said controller for releasing the gas pressure from said degasser responsive to operation of said controller.

10. The system of claim 9 wherein said degasser comprises a degasser tank provided in fluid communication with said conduit for receiving the fluid from said conduit and a level sensor provided in said degasser tank and operably connected to said controller for transmitting signals indicating a level of the fluid in said degasser tank to said controller.

* * * * *